US006079337A

United States Patent [19]

Huang et al.

[11] Patent Number: 6,079,337

[45] Date of Patent: Jun. 27, 2000

[54] SUPPORTING STRUCTURE

[75] Inventors: Danis Huang; Philip Chaw, both of Taipei Hsien, Taiwan

[73] Assignee: Cheng Loong Corporation, Taipei Hsien, Taiwan

[21] Appl. No.: 09/305,437

[22] Filed: May 6, 1999

[51] Int. Cl.[7] ..... B65D 19/00

[52] U.S. Cl. ..... 108/56.3; 108/51.3; 108/57.33

[58] Field of Search ..... 108/51.3, 56.3, 108/57.33, 56.1, 51.11, 57.19

[56] References Cited

U.S. PATENT DOCUMENTS

| | | | |
|---|---|---|---|
| 2,709,559 | 5/1955 | Geisler | 108/51.3 |
| 3,131,656 | 5/1964 | Houle | 108/51.3 |
| 5,218,913 | 6/1993 | Winebarger et al. | 108/56.1 X |
| 5,483,875 | 1/1996 | Turecek et al. | 108/51.3 |
| 5,784,971 | 7/1998 | Chang | 108/51.3 |

*Primary Examiner*—Janet M. Wilkens
*Attorney, Agent, or Firm*—Rosenberg, Klein & Lee

[57] ABSTRACT

A supporting structure, comprises a first plate including a rectangular upper surface and two side walls bridged along the lengthwise sides of the upper surface with folded line therebetween and vertical to the upper surface, the first plate having two first embedding slots parallel to the shorter sides thereof and extending over the side wall, and a second plate including a rectangular bottom surface and two side walls bridged along the lengthwise sides of the bottom surface with folded line therebetween and vertical to the bottom surface, the second plate having two second embedding slots parallel to the shorter sides thereof and extending over the side wall; a through hole being provided between the second embedding slots connected with the second embedding slots. The two side walls of the first plate are engaged into the second embedding slots of the second plate, the two side walls of the second plate are engaged into the first embedding slots of the first plate the first and second plates are embedded into each other to form a supporting structure.

16 Claims, 13 Drawing Sheets

SUPPORTING STRUCTURE

FIELD OF THE INVENTION

The present invention relates to a supporting structure, more particularly, to a supporting structure with simple configuration and easy assembling, and being able to easily form paper pallet of various size.

BACKGROUND OF THE INVENTION

The pallets are convenient means for transporting heavy goods, wherein a pack of goods are placed on the pallet and the patter is moved by a forklift.

The conventional pallets are generally made of wood, metal or plastic. However, the above-mentioned materials are hard to reuse and more bulk and heavy. Pallets made of the above materials raise environmental concerns, and their collection and retransport tend to be prohibitively expensive.

The paper pallet made of corrugated paper is developed to overcome the above problems. The paper material is more lightweight and can be recycled to save resource. Moreover, the corrugated papers for forming the paper pallet are planar configuration, thus facilitates shipping thereof.

FIGS. 12 and 13 show a conventional paper pallet composed of two longitudinal beams 10*a* and two lateral beams 11*a*. The beams 10*a* and 11*a* are made of corrugated paper boards bent to desired shape and die longitudinal beams 10*a* and the lateral beams 11*a* are vertically embedded to each other.

However, the above-mentioned paper pallet is formed by embedding the longitudinal beams 10*a* and the lateral beams 11*a,* the constructional strength is not sufficient and those beams are easily to tear apart. Moreover, the beams have complicated structure.

It is tie object of tie invention to provide a supporting structure which as enhanced strength and simple assembling, and car be used to assemble a paper pallet.

In one aspect of the invention the supporting structure comprises a first plate and a second plate wherein the top surface of the first plate and the bottom surface of the second plate can together form a binding surface ot larger area, thus enhances the constructional strength of the pallet made of the supporting structure.

In another aspect of the invention, the first plate and the second plate arc embedded with each other by the first slot and the second slot thereof, while the top surface of the first plate is bound to an upper deck, and the bottom surface of the second plate is bound to a lower deck to form a pallet. By the propelling force on the upper and the lower deck, the first slot and the second slot are embedded to each other and the tearing of the paper pallet can be prevented.

The various objects and advantages of the present invention will be more readily understood from the following detailed description when read in conjunction with the appended drawing, in which:

DETAIL DESCRIPTION OF PREFERRED EMBODIMENT

Figure 1:
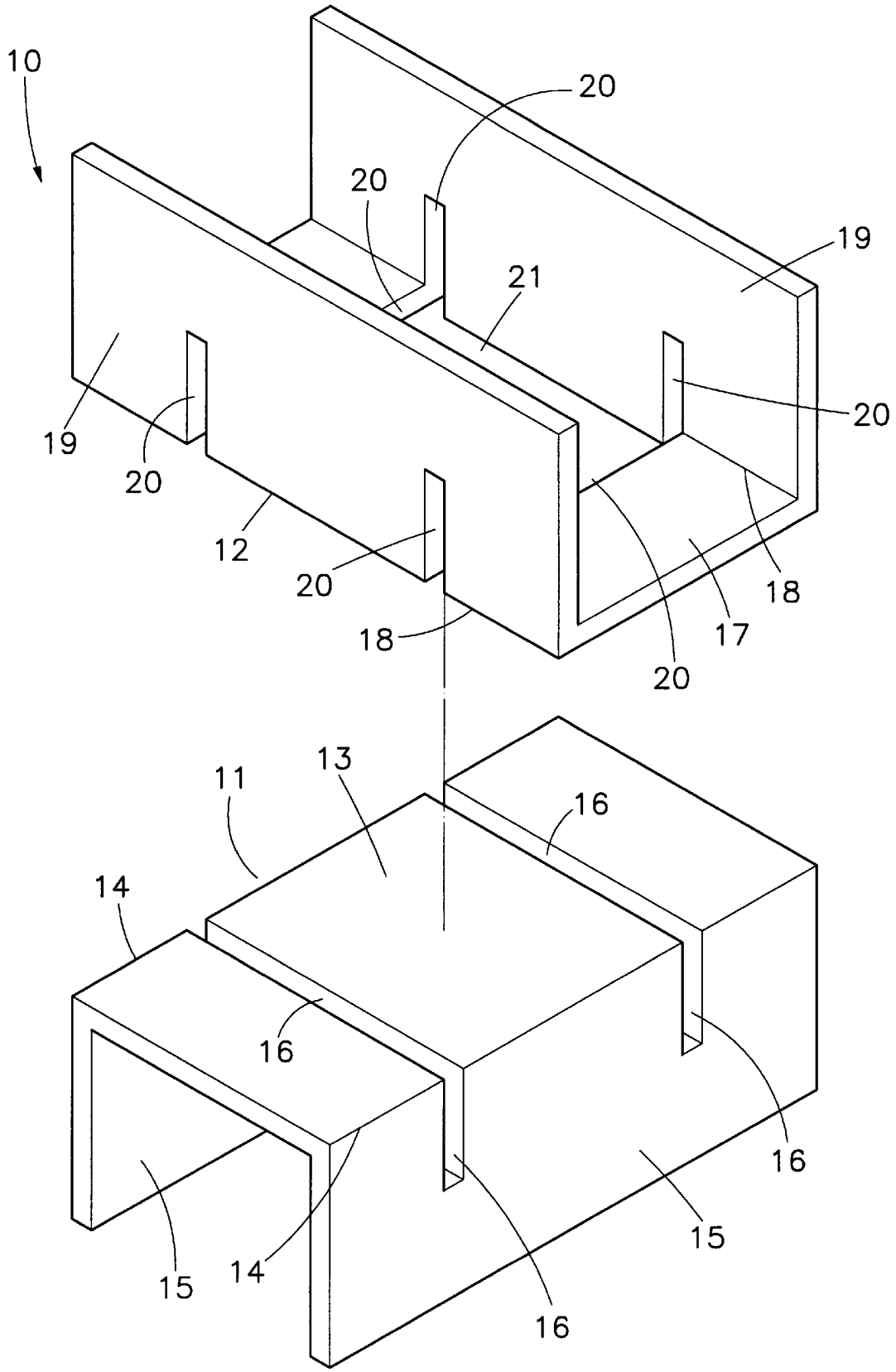
FIG. 1 is the exploded view of the first embodiment.

The present invention is intended to provide a supporting structure, which can be assembled between an upper deck and a lower deck to form a paper pallet. The 10 inventive supporting structure 10 comprises a first plate 11 and a second plate 12. which are formed by cutting and folding corrugated paper board, as shown in FIG. 1. The first plate 11 and the second plate 12 are vertically embedded to each other to form the supporting structure 10 as shown in FIG. 2.

With reference again to FIG. 1, the first plate 11 includes a rectangular upper surface 13 and two side walls 15 bridged along the lengthwise sides of the upper surface 13 with folded line 14 and vertical to the upper surface 13. The first plate therefore has an inverted U-shaped cross section. The upper surface 13 further comprises two first embedding slots, or grooves, 16 parallel to the shorter sides thereof and extending over the side wall 15 with a predetermined length.

The second plate 12 includes a rectangular bottom surface 17 and two side walls 19 bridged along the lengthwise sides of the bottom surface 17 with folded line 18 and vertical to the bottom surface 17. The second plate therefore has a L-shaped cross section. The bottom surface 17 further comprises two second embedding slots, or grooves, 20 parallel to the shorter sides thereof and extending over the side wall 19 with a predetermined length. A through hole 21 is provided between two second slots 20 on the bottom surface 17 and communicated with the second slots 20.

Figure 2:
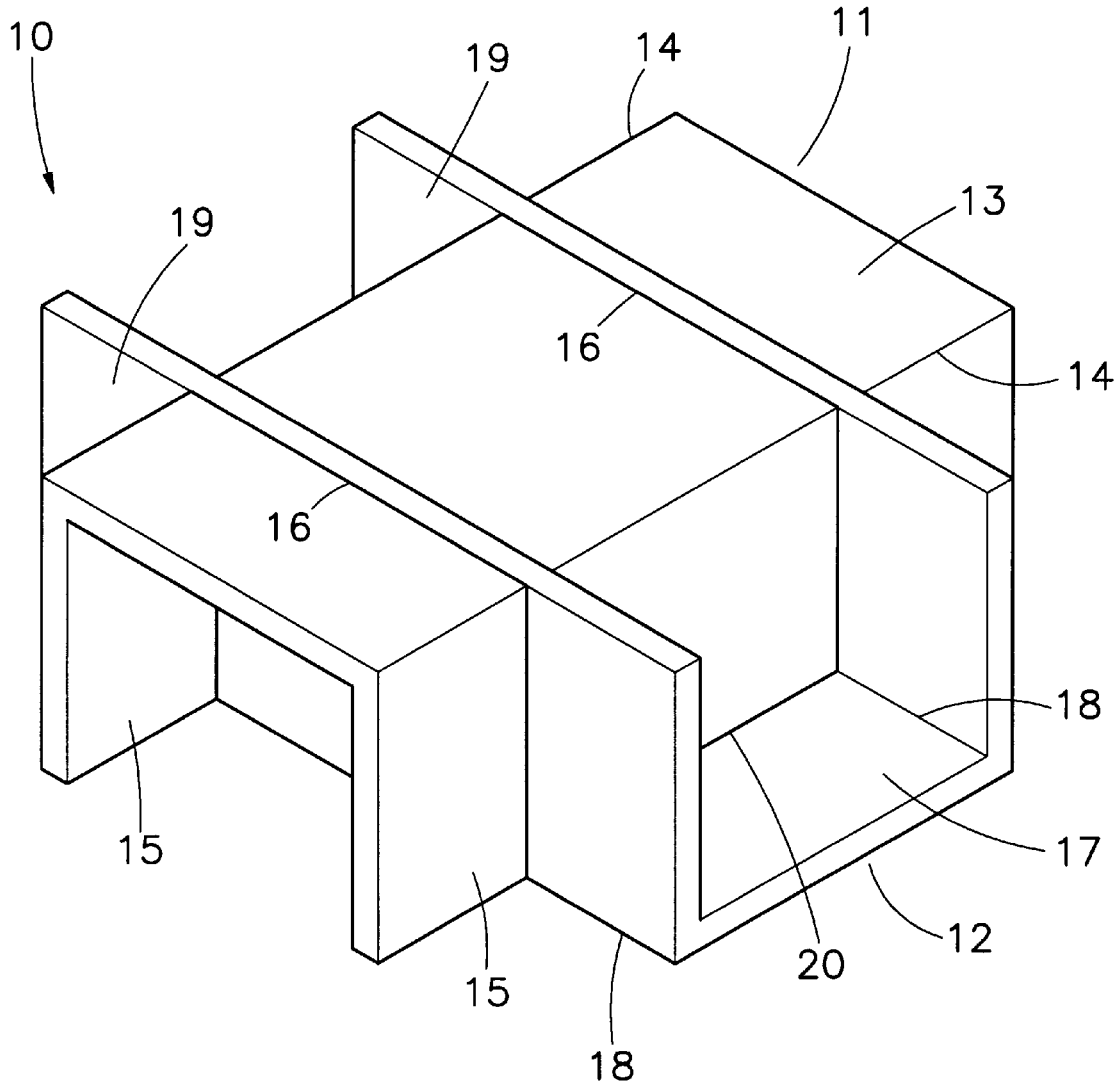
FIG. 2 is the perspective view of the first embodiment

As shown in FIG. 2, the first plate 11 is embedded with the second plate 12 such that the two side walls 15 of the first plate 11 are embedded within the second slots 20 of the second plate 12, and the two side walls 19 of the second plate 12 are embedded within the first slots 16 of the first plate 11 until the top surface 13 of the first plate ii is aligned with the upper end of the two side walls 19 of the second plate 12. and the bottom surface 17 of the second plate 12 is aligned with the lower end of the two side walls 15 of the first plate 11. The first plate 11 and the second plate 12 are vertically embedded to form a supporting structure 10, wherein the side walls 15 and 19 are cross to each other. Therefore, the supporting structure can endure larger pressure.

Figure 3:
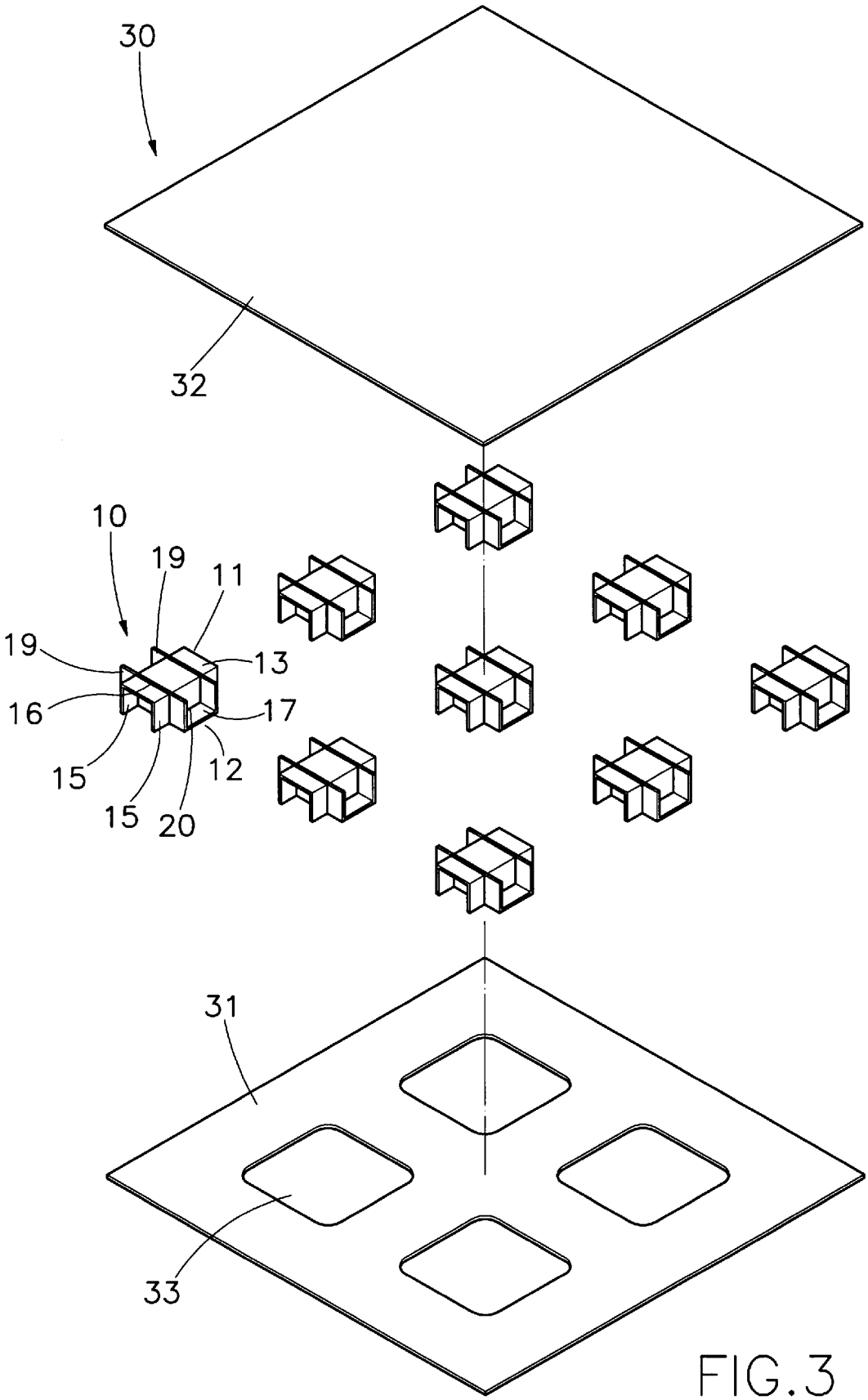
FIG. 3 shows the exploded view of the first embodiment when being applied to a paper pallet.
Figure 4:
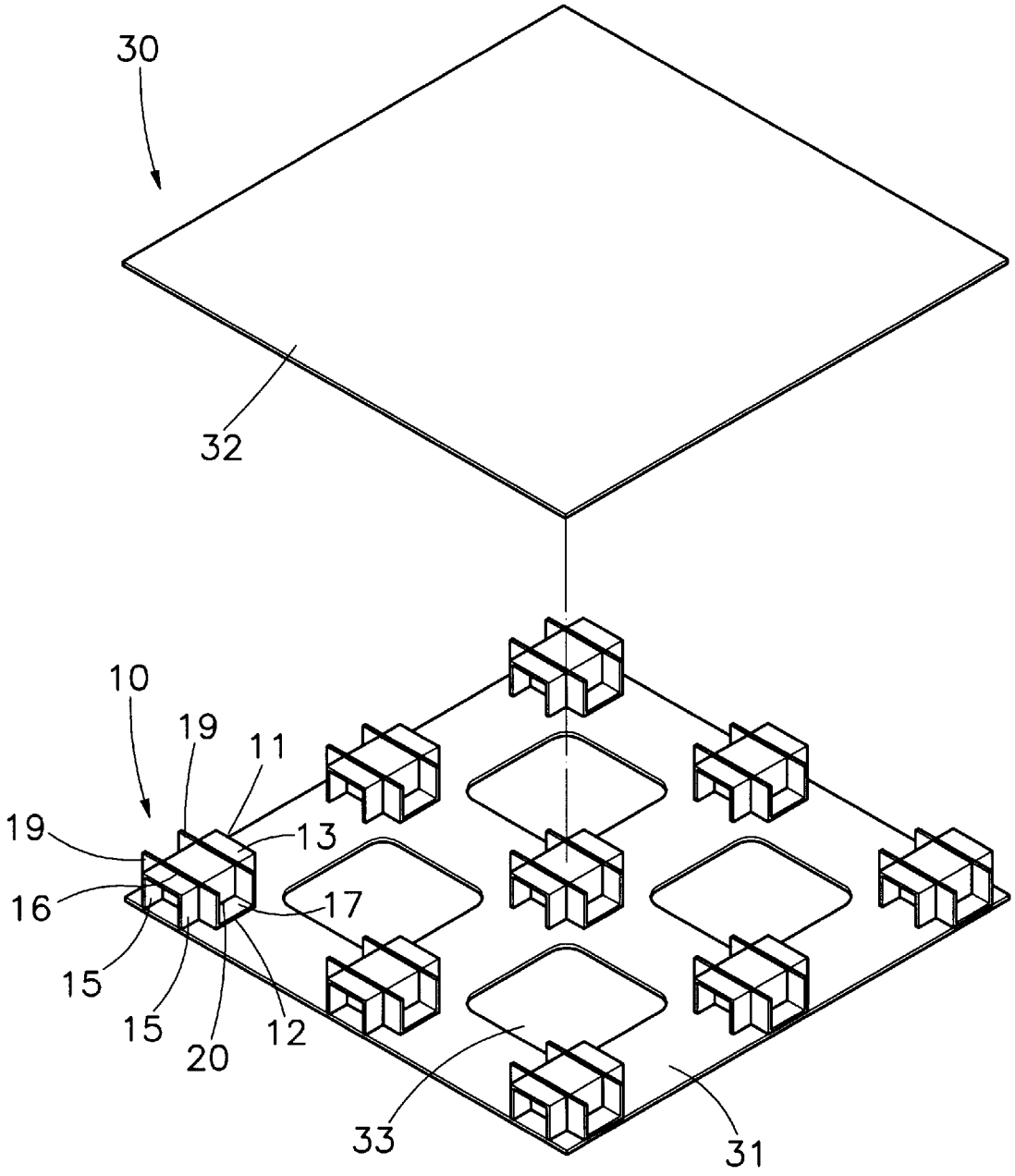
FIG. 4 shows the exploded view of the first embodiment when being applied to a paper pallet, wherein the supporting structure is assembled to the lower deck.
Figure 5:
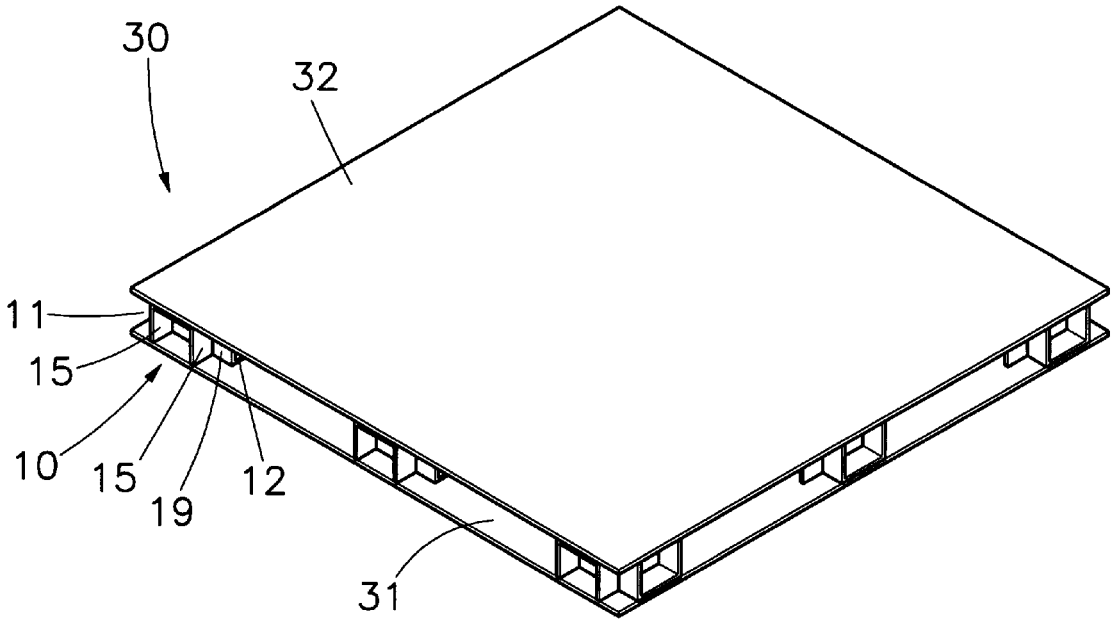
FIG. 5 shows the perspective view of the first embodiment when being applied to a paper pallet.

As shown in FIGS. 3–5, a plurality of inventive supporting structures 10 are arranged between a lower deck 31 and an upper deck 32 to form a paper pallet 30. The top surface 13 of the first plate 11 and the bottom surface 17 of the second plate 12 are bound to the bottom side of the upper deck 32 and the top side of the lower deck 31, respectively. Runners are formed between adjacent supporting structures 10 and between the upper deck 32 and the lower deck 31 to allow the insertion of the forklift. Moreover, a plurality of openings 33 are formed on the lower deck 31.

In the paper pallet formed by the inventive supporting structure 10, the top surface 13 and the bottom surface together provide a large attaching area with the upper deck 32 and the lower deck 31. Moreover, the top surface 13 of the first plate 11 is bound to the upper deck 32 and the bottom surface 17 of the second plate 12 is bound to the lower deck 31, while the first and second embedding grooves are embedded to each other. The paper pallet 30 thus formed can be prevented from tearing apart.

Moreover, the inventive structure 10 has simple configuration, and the number thereof can be adjusted for paper pallet of various size. The cost of molding is reduced.

Figure 6:
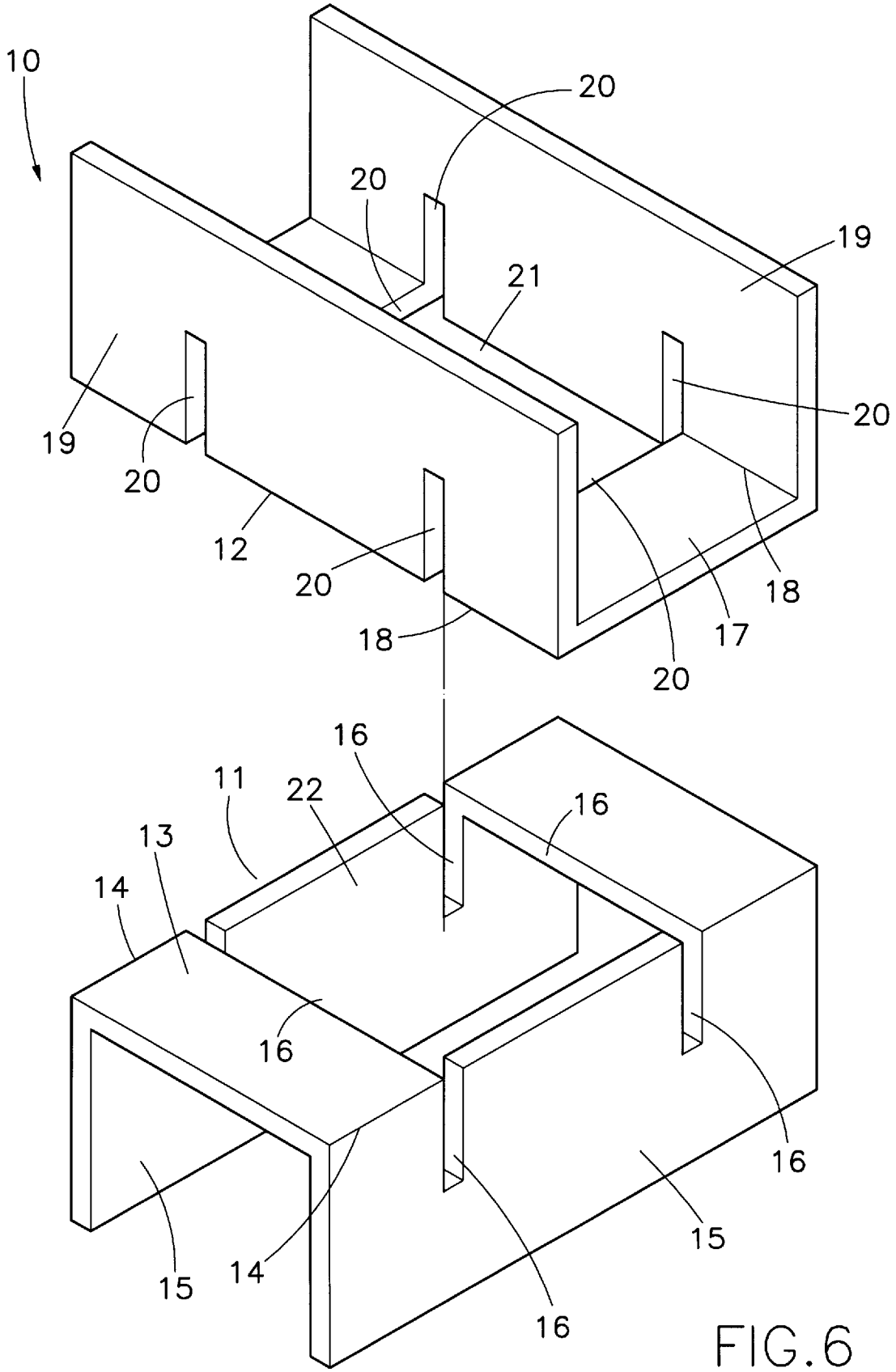
FIG. 6 is the exploded view of the second embodiment.
Figure 7:
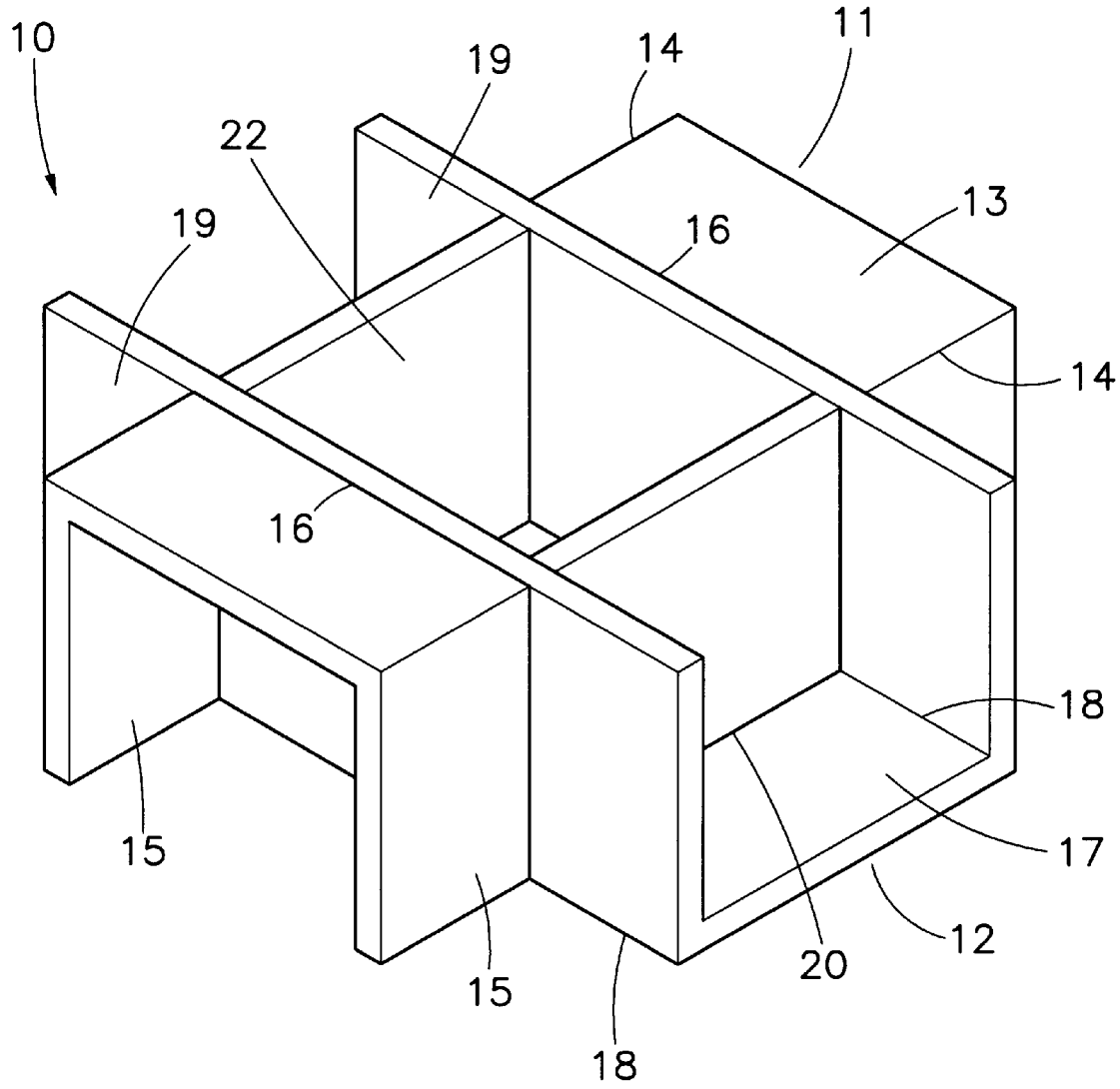
FIG. 7 is the perspective view of the second embodiment

As shown in FIGS. 6 and 7, a through hole 22 is formed between the two first embedding grooves 16 of the top surface 13 of the first plate 11 in the supporting structure 10, and communicated with the first embedding grooves 16

Figure 8:
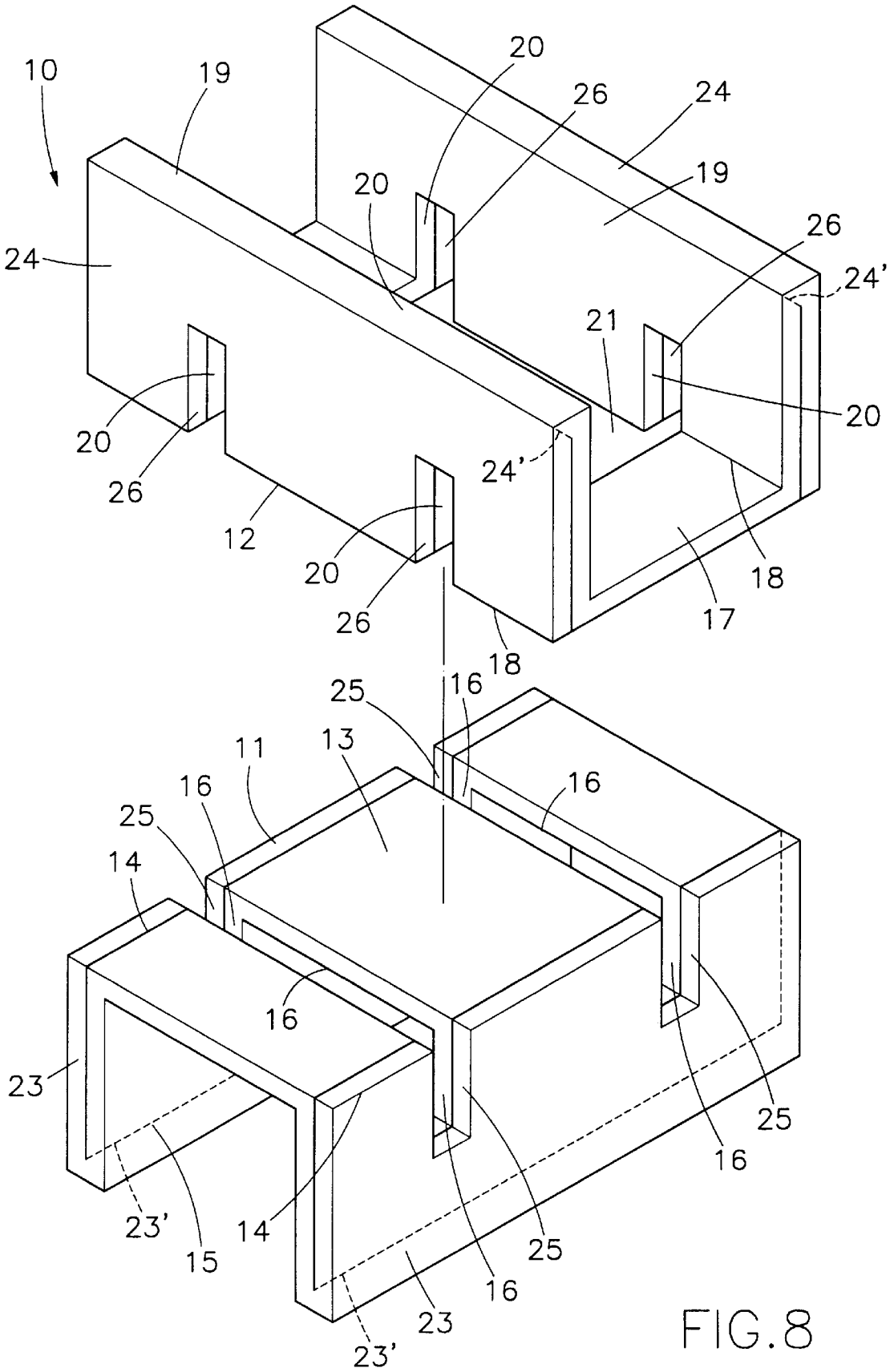
FIG. 8 is the exploded view of the third embodiment.
Figure 9:
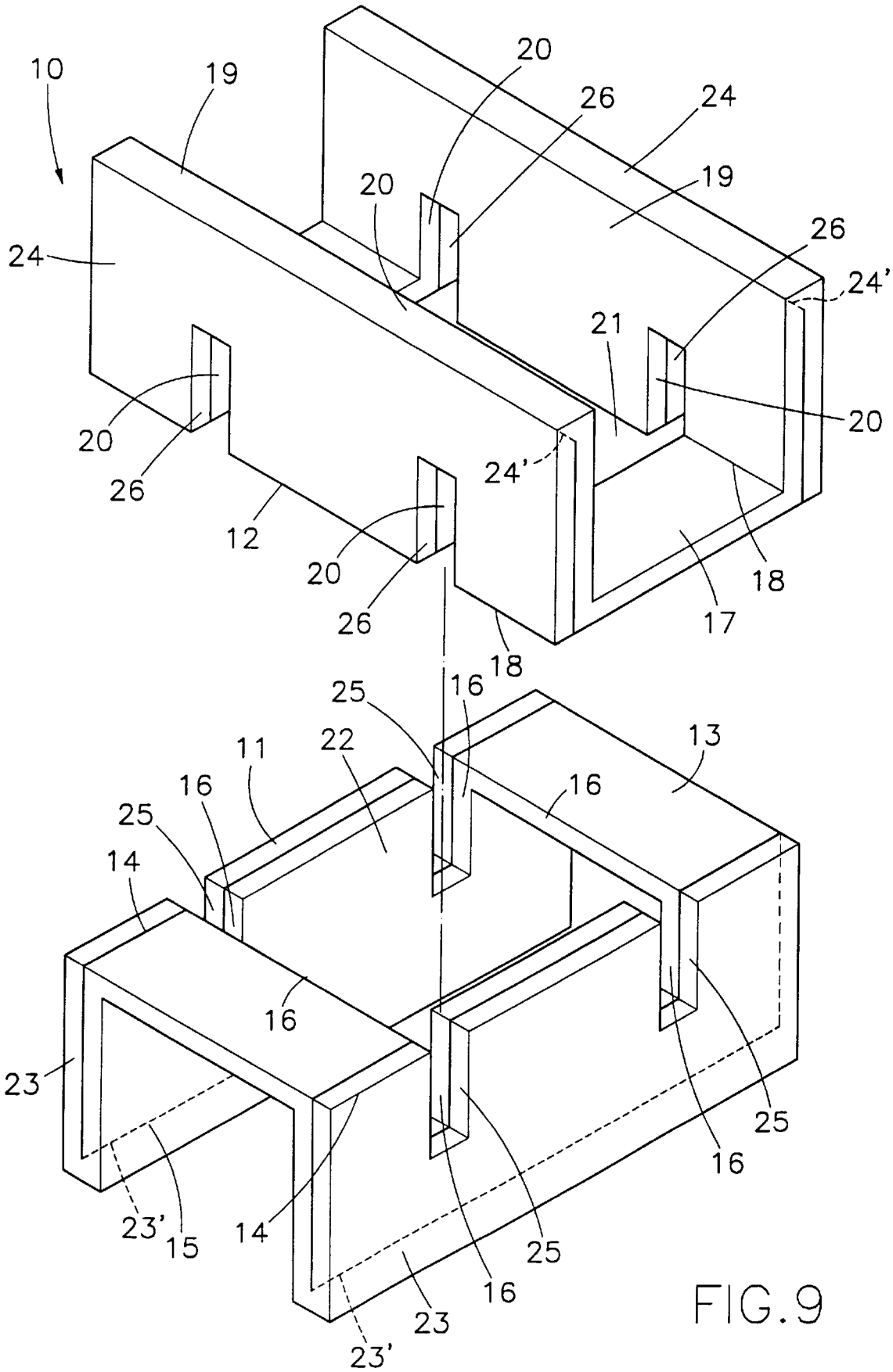
FIG. 9 is the exploded view of the fourth embodiment.

As shown in FIGS. 8 and 9, a first reinforcing plate 23 is provided on the lower portion of each side wall 15 of the first plate 11 and a second reinforcing plate 24 is provided on the upper portion of each side wall 19 of the second plate, wherein the first and the second reinforcing plates 23 and 24 can be bent at respective bend lines 23' and 24' to bear against the outer sides of the side wall 15 and 19, respectively. Moreover, a third embedding slot, or groove, 25 is arranged on the first reinforcing plate 23 and corresponding to the first embedding groove, a fourth embedding slot, or groove, 16 is arranged on the second reinforcing plate 24 and corresponding to the second embedding groove. The side walls 15 and the first reinforcing plates 23 are embedded into the second and the fourth embedding grooves 20 and 26, respectively, the side walls 19 and the second reinforcing plates 24 are embedded into the first and the third embedding grooves 16 and 25, respectively.

Figure 10:
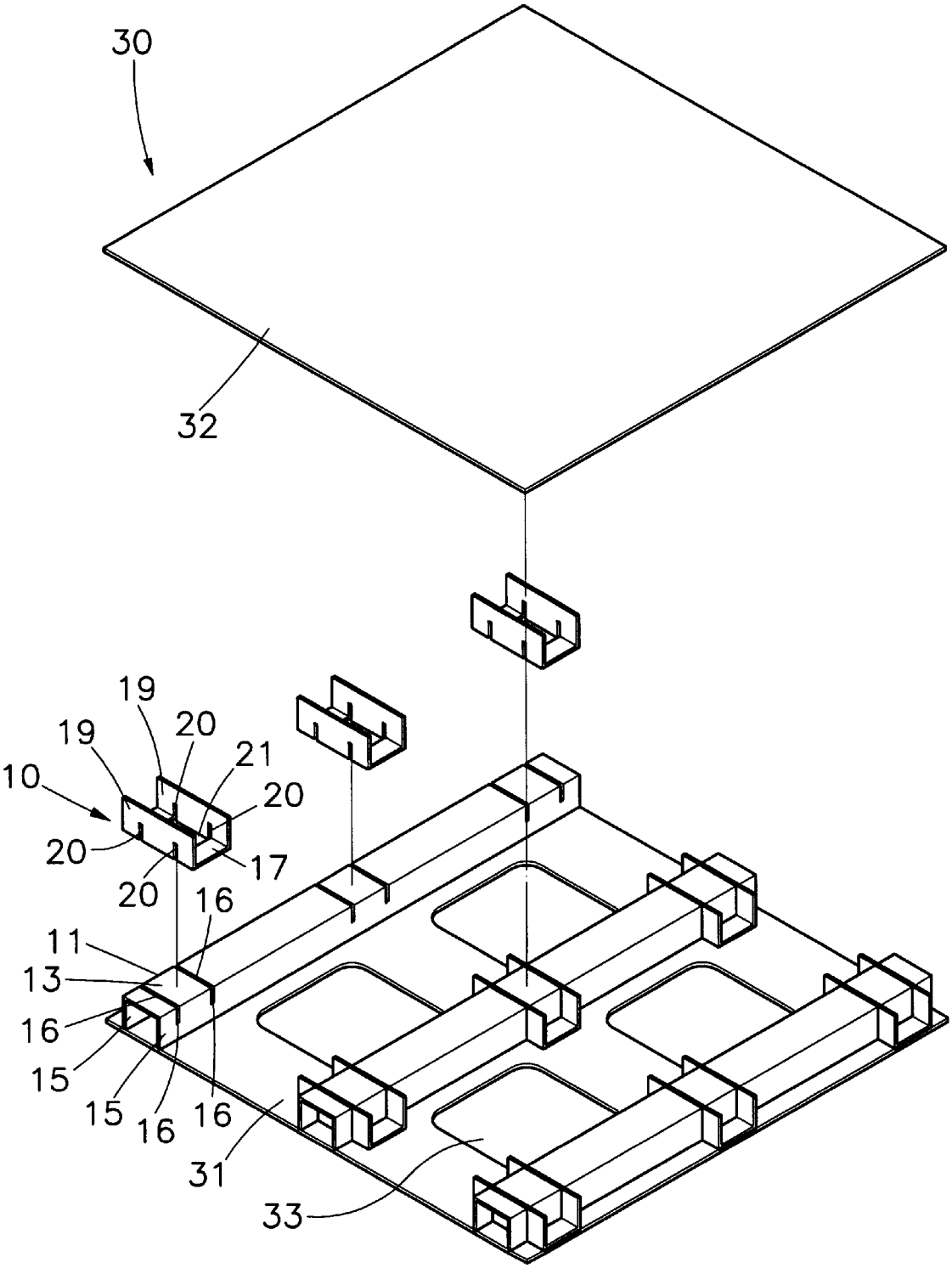
FIG. 10 shows the exploded view of the fifth embodiment when being applied to a paper pallet, wherein the supporting structure is assembled to the lower deck.
Figure 11:
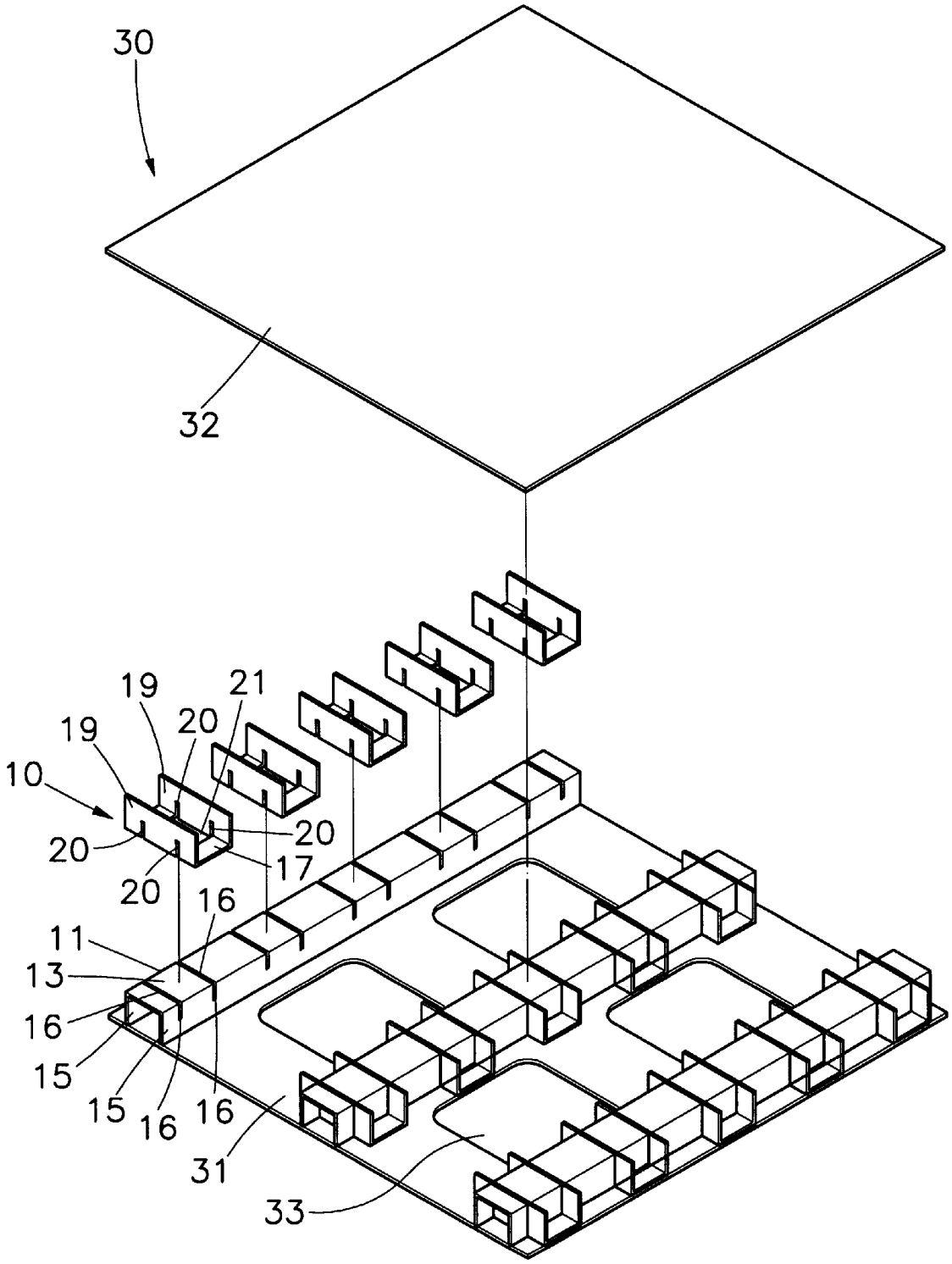
FIG. 11 shows the exploded view of the sixth embodiment when being applied to a paper pallet wherein the supporting structure is assembled to the lower deck.
Figure 12:
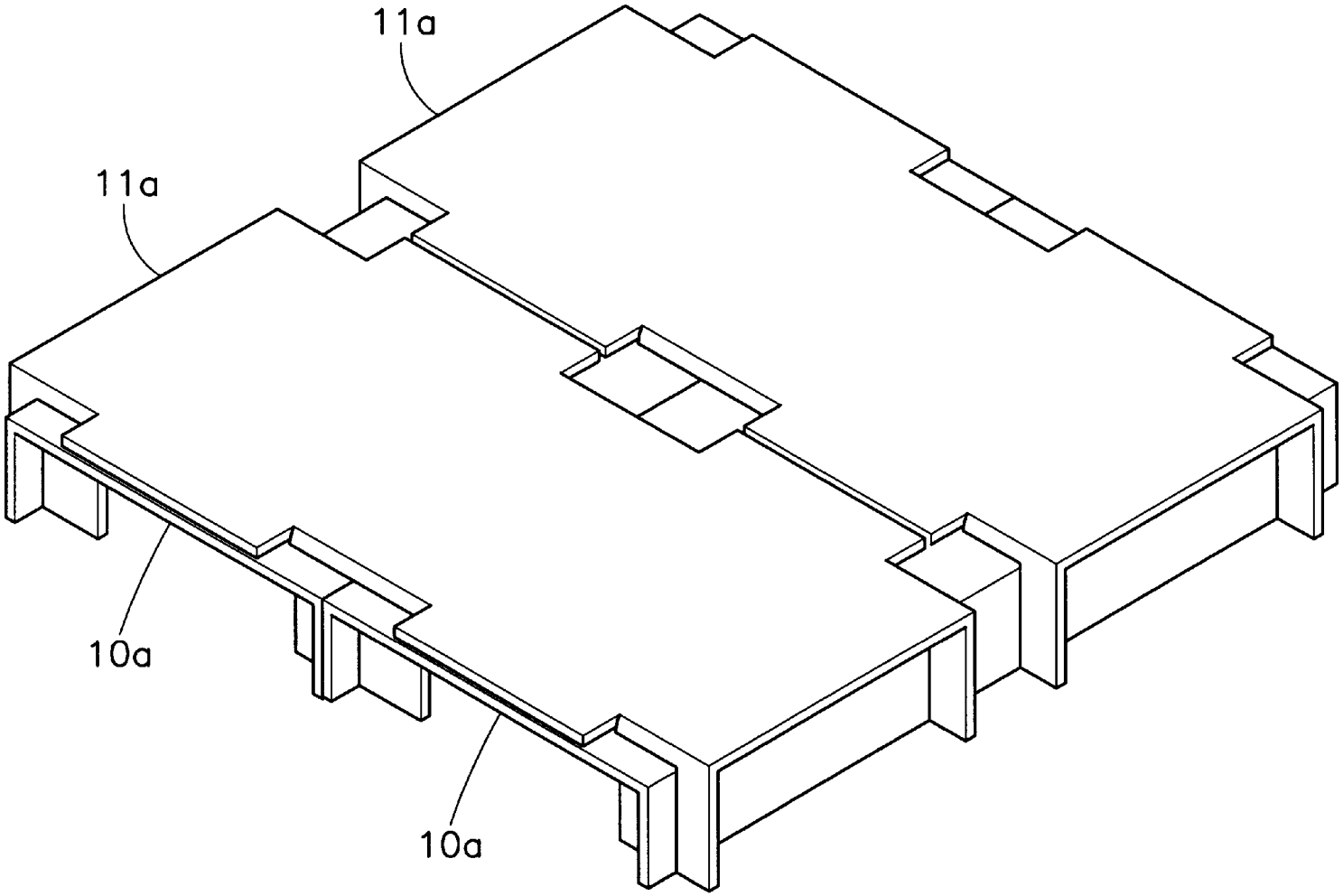
FIG. 12 PRIOR ART
FIG. 12 is the perspective view of a conventional paper pallet.
Figure 13:
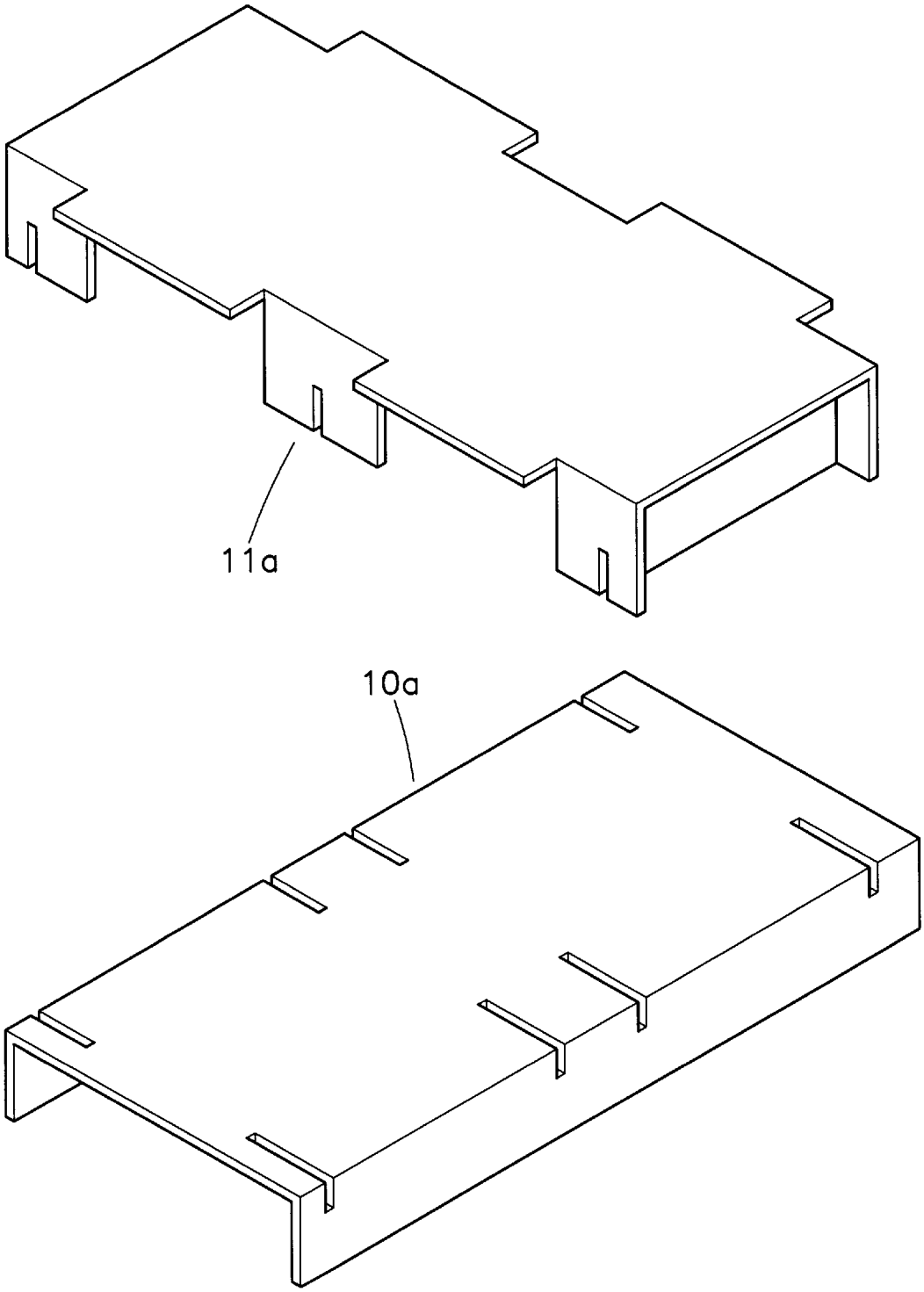
FIG. 13 PRIOR ART
FIG. 13 shows the longitudinal and lateral beams in a conventional paper pallet.

As shown in FIGS. 10 and 11, the first plates 11 for constituting one row of the supporting structure are integrally formed and of strip-shape.

Although the present invention has been described with reference to the preferred embodiment thereof. it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

What is claimed is:

1. A support structure assembly comprising:

(a) a first plate member including a pair of longitudinally extended first side wall portions spaced one from the other and a substantially planar upper surface portion extending transversely therebetween, said first plate member having formed therein at least a pair of first embedding slots, each said first embedding slot extending transversely across said upper surface portion and into said first side wall portions; and, (b) a second plate member coupled to said first plate member, said second plate member including a pair of laterally extended second side wall portions spaced one from the other and a substantially planar bottom surface portion extending transversely therebetween, said second plate member having formed therein at least a pair of second embedding slots, each said second embedding slot extending transversely across said bottom surface portion and into said second side wall portions;

at least one of said upper and bottom surface portions having formed therein a through hole communicating with said embedding slots thereof;

said first side wall portions of said first plate member respectively engaging said second embedding slots of said second plate member, said second side wall portions of said second plate member respectively engaging said first embedding slots of said first plate member.

2. The supporting structure assembly as recited in claim 1 wherein each of said first and second plate members is integrally formed of a corrugated paper material.

3. The supporting structure assembly as recited in claim 1 wherein said upper and lower surface portions are each configured with a substantially rectangular contour.

4. The supporting structure assembly as recited in claim 3 wherein said first embedding slots are disposed substantially in parallel and longitudinally offset manner, and said second embedding slots are disposed substantially in parallel and laterally offset manner.

5. The supporting structure assembly as recited in claim 1 wherein said second plate member is configured with substantially a U-shaped general contour, and said first plate member is configured with substantially an inverted U-shaped general contour.

6. The supporting structure assembly as recited in claim 1 wherein each of said first sidewall portions extend vertically from said upper surface portion, and each of said second sidewall portions extend vertically from said b otto m surface portion.

7. The supporting structure assembly as recited in claim 1 wherein said through hole is formed in said bottom surface portion of said second plate member to extend laterally from one said second embedding slot to the other.

8. The supporting structure assembly as recited in claim 1 wherein said through hole is formed in said upper surface portion of said first plate member to extend longitudinally from one said first embedding slot to the other.

9. The supporting structure assembly as recited in claim 1 wherein said first plate member further includes at least a pair of first reinforcing plates respectively coupled to said first side wall portions, each said first reinforcing plate at least partially overlaying one said first side wall portion.

10. The supporting structure assembly as recited in claim 9 wherein said second plate member further includes at least a pair of second reinforcing plates respectively coupled to said second side wall portions, each said second reinforcing plate at least partially overlaying one said second side wall portion.

11. The supporting structure assembly as recited in claim 10 wherein each of said first reinforcing plates is integrally formed with one said first sidewall portion, each said first reinforcing plate being defined by a bend at a periphery of one said first sidewall portion.

12. The supporting structure assembly as recited in claim 11 wherein each of said second reinforcing plates is integrally formed with one said second sidewall portion, each said second reinforcing plate being defined by a bend at a periphery of one said second sidewall portion.

13. The supporting structure assembly as recited in claim 10 wherein each said second reinforcing plate has formed therein a plurality of fourth embedding slots, each said fourth embedding slot being substantially aligned with one said second embedding slot.

14. The supporting structure assembly as recited in claim 9 wherein each said first reinforcing plate has formed therein a plurality of third embedding slots, each said third embedding slot being substantially aligned with one said first embedding slot.

15. A paper pallet comprising:

(a) a substantially planar upper deck;

(b) a substantially planar lower deck opposing said upper deck; and, (c) a plurality of support structure assemblies disposed between said upper and lower decks, each said support structure assembly including:

(1) a first plate member including a pair of longitudinally extended first side wall portions spaced one from the other and a substantially planar upper surface portion extending transversely therebetween, said first plate member having formed therein at least a pair of first embedding slots, each said first embedding slot extending transversely across said upper surface portion and into said first side wall portions; and, (2) a second plate member coupled to said first plate member, said second plate member including a pair of laterally extended second side wall portions spaced one from the other and a substantially planar bottom surface portion extending transversely therebetween, said second plate member having formed therein at least a pair of second embedding slots, each said second embedding slot extending transversely across said bottom surface portion and into said second side wall portions;

wherein at least one of said upper and bottom surface portions has formed therein a through hole communicating with said embedding slots thereof; and, said first side wall portions of said first plate member respectively engage said second embedding slots of said second plate member, and said second side wall portions of said second plate member respectively engage said first embedding slots of said first plate member.

16. The paper pallet as recited in claim 15 wherein at least one of said support structure assemblies includes a plurality of said first plate members integrally formed and disposed in longitudinally aligned manner.

* * * * *